United States Patent [19]

May

[11] 4,089,075

[45] May 16, 1978

[54] HOLDER

[76] Inventor: Marvin I. May, 960 Second St., Hermosa Beach, Calif. 90254

[21] Appl. No.: 823,836

[22] Filed: Aug. 11, 1977

Related U.S. Application Data

[63] Continuation of Ser. No. 710,435, Aug. 2, 1976, abandoned, which is a continuation-in-part of Ser. No. 622,677, Oct. 15, 1975, Pat. No. 3,973,282.

[51] Int. Cl.[2] ..... A47C 27/08

[52] U.S. Cl. ..... 5/370; 5/317 R; 24/67.5

[58] Field of Search ..... 5/317 R, 320, 322, 345 R, 5/349, 350; 297/217, 452; 24/67.5, 67.11

[56] References Cited

U.S. PATENT DOCUMENTS

| | | | |
|---|---|---|---|
| 2,400,058 | 5/1946 | Concannon | 24/67.5 |
| 3,973,282 | 8/1976 | May | 5/370 |
| 3,999,236 | 12/1976 | Macauley | 5/370 |

*Primary Examiner*—Casmir A. Nunberg
*Attorney, Agent, or Firm*—Romney, Schaap, Golant, Scillieri, Disner & Ashen

[57] ABSTRACT

A holder having a wide usage for holding plastic, cloth or paper against a surface. The holder is made of extruded plastic and includes a leg portion, a bowed base and a head portion for bearing against a surface. An arm may also be included for easily pivoting the head portion away from the surface. The holder may be used to restrain a water bed liner, curtains, valances, ruffles and paper memos for example. In addition, the holder may be placed back to back with another holder to form a clothespin type device.

3 Claims, 18 Drawing Figures

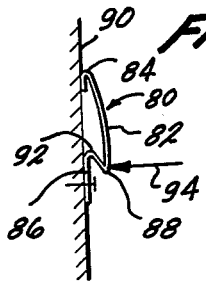
FIG. 9
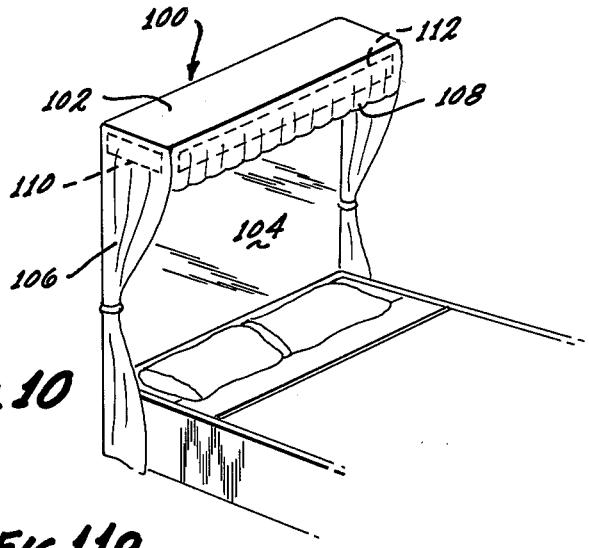
FIG. 10
FIG. 11
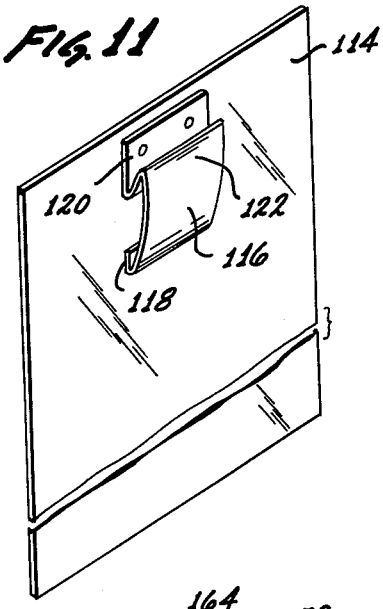
FIG. 11a
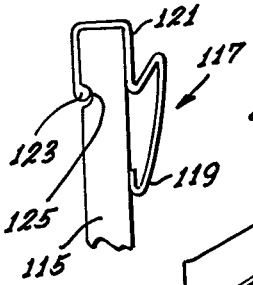
FIG. 12
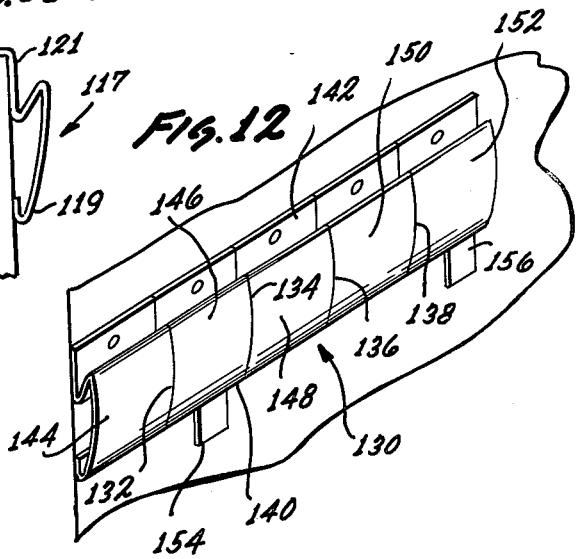
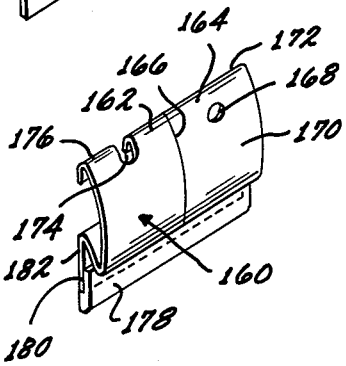
FIG. 13
FIG. 15
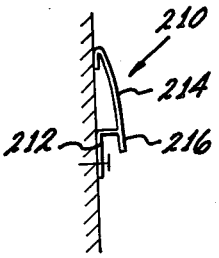
FIG. 16
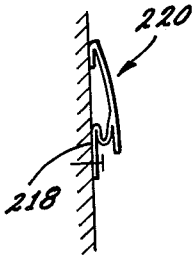
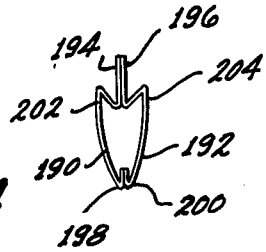
FIG. 14

HOLDER

CROSS-REFERENCE TO RELATED APPLICATION

This is a continuation of application Ser. No. 710,435, filed Aug. 2, 1976, now abandoned which is a continuation in part of my earlier filed application, Ser. No. 622,677, Water Bed Liner Holder filed on Oct. 15, 1975, now U.S. Pat. No. 3,973,282.

BACKGROUND OF THE INVENTION

1. Field of the Invention

The present invention relates to a holder, and more particularly, to a simply constructed one piece holder which may be attached to a surface for retaining an object such as a piece of plastic, cloth or paper. Among the holder's many advantages are its ease of use an its low cost.

2. Description of the Prior Art

With regard to one specific field, the wide-spread popularity and usage of water beds has created a unique problem which if unchecked could cause sudden and substantial damage. A water bed holds a substantial amount of water; should the water mattress rupture, there is the likelihood of enormous water damage to other furniture as well as to building structure.

In the short time since the water bed has achieved wide-spread popularity, various methods and devices have been developed to hold a plastic liner within a frame over which the water mattress is then placed. The liner is to act as a water reservoir should the mattress rupture, thereby containing the water within the bed frame.

Generally, the prior art attachment methods have included the placement of the ends of the liner between two complimentary elements which are snapped together. For example, capping strips have been developed to snap onto the uppermost edge of a frame with the plastic liner squeezed between the strip and the frame edge. Other strips have been developed to press into grooves cut along the interior lateral surfaces of the frame; again, the liner is supposed to be captured between the grooved frame surfaces and the inserted strip. Other prior art devices include tack strips which are nailed to the interior surfaces of the frame; once again, the liner is to be captured between the tack strip and the frame. Another prior art method is to simply tack the upper edge of the liner to the interior lateral surfaces of the frame.

A more recent prior art device used for liner retention is shaped like a match cover and is tacked or nailed to the interior lateral surfaces of a frame. The liner is then placed inside the cover for retention.

Generally, all of the prior art devices suffer from one or more major disadvantages. Among these include such functional problems as the inability to restrain the liner in use; that is, the liner slips away from the device which is supposed to hold it. Another problem is the great difficulty encountered in installing the prior art device to the bed frame and/or in attaching the liner and the device together. Some prior art devices have been found to be exceedingly difficult to pry open or snap shut. Still other devices and attachment methods permanently damage the liner so that the liner must be discarded if the bed is moved; others damage the liner so badly during installation that it can no longer perform its watercontaining function.

Other problems in the prior art include matters of aesthetics. For example, some devices require an exact fitting of the liner; if the fit is not exact, the edge of the liner will become an unsightly protrusion. Trimming the liner before installation introduces difficult tolerance problems.

In a broader view, there are many different attachment devices, many of which are commonly found in household use. For example, there are curtain and drapery rods and brackets, valance rods and brackets, devices for holding ruffles, additional devices for holding pictures and other wall hangings and even devices used on clip boards and note and memo holders. Even the common clothespin is an example of a prior art attachment device.

In general, the above mentioned attachment devices are relatively complicated structurally, expensive, ugly in appearance and difficult to use. Of course it is always commercially desirable to have a product that is relatively inexpensive, simply constructed and yet reliable in operation.

SUMMARY OF THE INVENTION

The above prior art problems have now been overcome by the present invention which provides a holder for constraining movement of an object between itself and a surface comprising a base of resilient material, the base being bowed to form with the surface a space for storage of a portion of said object; a leg portion connected to the base for bearing against the surface and for positioning and securing the holder; and a head portion connected to the base for bearing against the surface, with a portion of the object being receivable between the head portion and the surface.

It is an aim of the present invention to provide a holder which is inexpensive, widely adaptable, yet reliable and simply constructed.

Another aspect of the present invention is to provide a holder which is exceedingly easy to use so as to allow quick and easy engagement and disengagement of the object whether the object is plastic (such as a water bed liner) cloth (such as a valance or ruffle) or paper.

Still another object of the present invention is to provide a simple holder which may be used to mount valances, ruffles, draperies, window treatments or to hold memos, notes or other pieces of paper.

Other objects and advantages of the present invention will become evident upon reading the following description in conjunction with the accompanying drawings.

BRIEF DESCRIPTION OF THE DRAWINGS

FIG. 9 is a diagrammatic elevational sectional view of a holder illustrating yet another variation;

FIG. 10 is a perspective view of a canopy for a bed illustrating the usage of the holder for the attachment of ruffles and other decorative items;

FIG. 11 is a perspective view illustrating the holder in a "clip board" variation;

FIG. 11*a* is a diagrammatic elevational sectional view of another clip board variation;

FIG. 12 is a perspective view of the holder illustrating its use as a note retaining device;

FIG. 13 is a perspective view of a holder illustrating finger openings and a mounting bar;

FIG. 14 is a diagrammatic elevational sectional view illustrating the holder in a "clothespin" configuration.

FIGS. 15 and 16 are diagrammatic elevational sectional view of holders illustrating additional embodiment variations.

DESCRIPTION OF THE PREFERRED EMBODIMENTS

Figure 1:
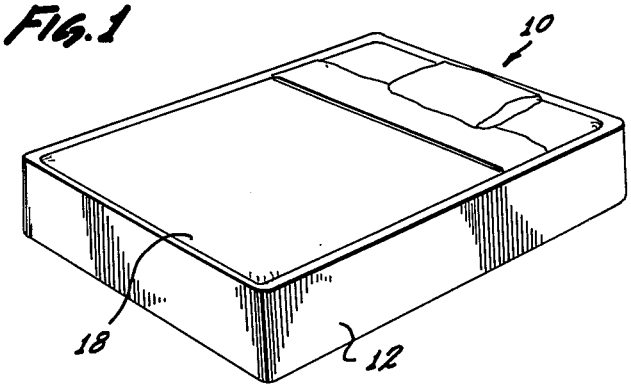
FIG. 1 is a perspective view of a water bed including a frame.

While the present invention is susceptible of various modifications and alternative constructions, illustrative embodiments are shown in the drawing and will herein be described in detail. It should be understood, however, that it is not the intention to limit the invention to the particular forms disclosed, but, on the contrary, the intention is to cover all modifications, equivalences and alternative constructions falling within the spirit and scope of the invention as expressed in the appended claims.

Figure 2A:
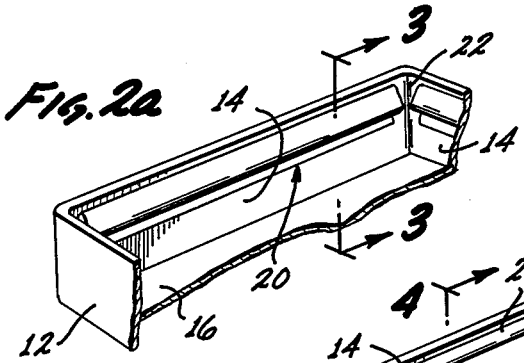
FIG. 2*a* is an enlarged perspective view of a portion of the water bed frame shown in FIG. 1 illustrating an embodiment of the present invention.

Referring now to FIGS. 1 and 2, there is illustrated a water bed 10 having a rectangularly shaped frame 12 having interior lateral surfaces or perimeter 14 and a bottom member 16. Located on top of the bottom member 16 and within the perimeter is a water-filled mattress 18.

Referring again to FIG. 2, there is illustrated the rather simplistic construction and manner in which the inventive holder is attached to the frame. In more detail, the holder 20 is in the form of an elongated clip shown attached to the interior surfaces 14, extending substantially the length of each side of the perimeter and coming within about an inch and a half of each of the corners of the perimeter such as corner 22.

Figure 2B:
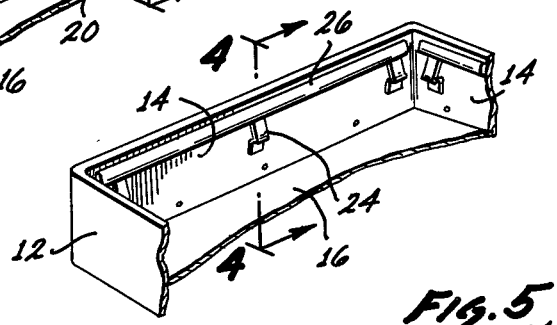
FIG. 2*b* is an enlarged perspective view of the frame shown in FIG. 1 illustrating another embodiment of the subject invention.

As shown, FIG. 2*b* illustrates another variation of the present invention and comprises a two piece liner restrainer having a clip section 24 to which is mated a rail section 26. As can be seen, the rail extends along substantially the length of a side of the perimeter while being supported by three spaced clip portions.

There are numerous advantages of the present invention including the fact that it is very inexpensive and may be easily used. The inventive holder includes a self-biasing feature and has room for the storage of excessive liner or other material so that exact dimensions are no longer critical.

Figure 3:
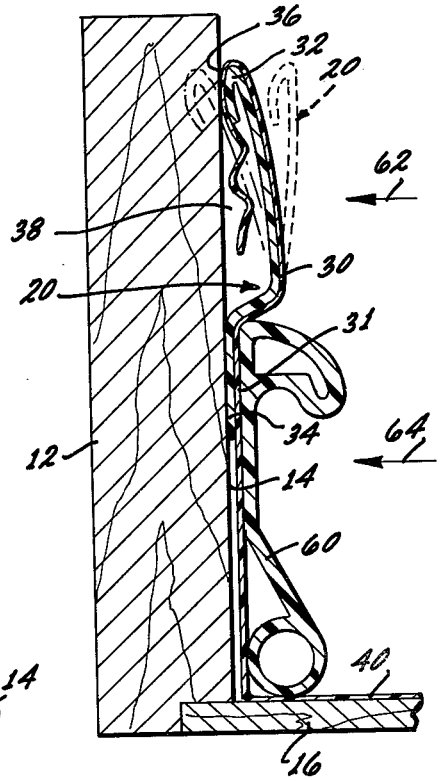
FIG. 3 is an enlarged elevational sectional view taken along line 3—3 of FIG. 2*a* illustrating the inventive liner holder in use.

Referring to FIG. 3, the clip 20 is shown in much greater detail. The clip includes three main portions, a base or center portion 30, an upper or head portion 32 and a lower or leg portion 34. The leg portion 34, as shown in FIG. 3 and as will be described below, is used to position and retain the clip in a preselected location by bearing against the interior lateral surfaces 14 of the frame.

The head portion 32 is designed with a slightly beveled top 36 to allow the insertion of the fingertips of an assembler. Inserting the fingers allows the performance of the dual operations of moving or flexing the head portion away from the frame (as shown in dotted line in FIG. 3) and the insertion of the ends of the liner 40 into a storage space 38. Integral with the head portion 36 and the leg portion 34 is the central portion 30 which is slightly bowed to form between itself and the surfaces 14 the storage space 38.

As can now be appreciated, the liner 40 may be installed simply by setting the main portion of the liner on the bottom 16 of the frame with the edges turned upwardly along the surfaces 14, along the contours of the clip 20 and around the head portion 32 into the space 38. Thus, the clip is completely covered. The initial set up or a readjustment or retucking to make the liner more taut can easily be accomplished by simply moving one's fingers downwardly along the beveled surface 36 of the clip so as to "stuff" the liner into the space 38. Because of the design of the clip and the resiliency of the clip material, not only does the center portion 30 provide a storage space but it also acts as a spring to provide a self-biasing force to automatically return itself to the position shown in FIG. 3 and press the head portion against the frame, thereby locking the liner in place.

It has been found that a holder of rigid polyvinylchloride material having a thickness of approximately 0.050 inches provides sufficient resiliency and works exceedingly well. Other preferable dimensions will be provided hereinbelow.

Figure 5:
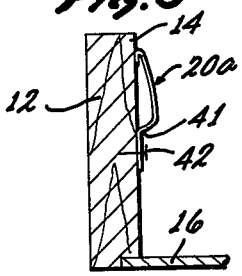
FIG. 5 is a diagrammatic elevational sectional view similar to FIG. 3 of a water bed frame and holder and illustrating one manner of attaching the liner holder to the frame.
Figure 6:
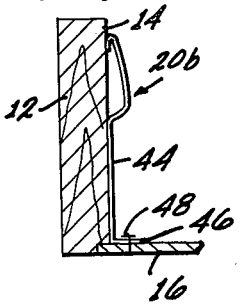
FIG. 6 is a diagrammatic elevational sectional view of a water bed frame and holder and illustrating another manner of attaching the holder to the frame.

Referring now to FIGS. 5–8, there is illustrated four holder variations. In each figure the holder is illustrated in position against the interior surface 14 of the frame 12. In FIG. 5, the leg or lower portion 41 of the holder 20*a* is placed flatly against the vertical interior surface and fastened by any suitable device such as a nail, screw or staple 42. In FIG. 6, the leg portion 44 of the holder 20*b* is extended and bent at right angles to form a horizontal foot 46 which in turn is fastened to the bottom member 16 of the frame by a tack 48.

Figure 7:
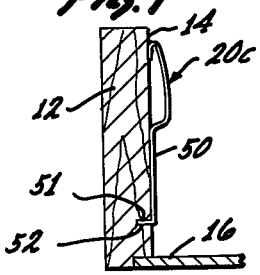
FIGS. 7 and 8 are diagrammatic elevational sectional view of frames and holders illustrating still other variations of attachment of the holder to the frame.
Figure 8:
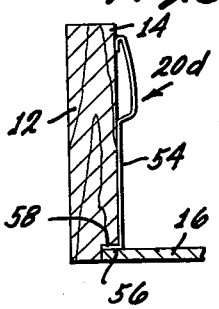

In FIG. 7, the leg portion 50 of the holder 20*c* is bent inwardly at a 90° angle to form a foot 51 which is received by a groove 52 in a press-fit engagement. In FIG. 8, the leg 54 of the holder 20*d* is also extended and bent at right angles to form a horizontal foot 56 which is received in a recess 58 between the vertical portion and the bottom member of the frame.

As can be readily seen, none of the attachment variations disclosed relative to FIGS. 5–8 interfere with the securing of the liner; the liner is not mutilated, torn or tacked in any way nor excessively stretched or distorted.

Referring back to FIG. 3, still another variation is illstrated for retaining the holder 20 in place. Abutting the leg portion 34 is an insert 60 which is described fully in my earlier U.S. Pat. No. 3,848,470 and which is incorporated herein by reference. The insert is used to restrain the bedding of the water bed. No fastener is needed because when the mattress is filled with water there will be a substantially outwardly directed pressure (illustrated by the arrows 62 and 64) applied against both the insert 60 as well as the holder 20. This pressure and the support from the insert will insure that the holder will remain in the location selected for it.

The holder 20 is designed to be made as a single inexpensive extruded piece, preferably of synthetic resin; yet with the variations illustrated, a water bed designer has a great latitude without having to compromise. Nevertheless whichever variation is used, assembly of the bed may be done quickly and easily without special tools.

As mentioned above, FIGS. 2*b* and 4 illustrate another variation of a holder which includes the clip section 24 and the rail section 26. The clip section 24 is comprised of its own lower portion 70, center portion 72 and upper portion 74. The lower portion 70 may be designed as previously discussed relative to FIGS. 3, 5, 6, 7 and 8 while the center portion 72 may be identical to the center portion 30 of the FIG. 3 embodiment. The upper portion 74 differs from the FIG. 3 embodiment in that its geometry is generally complemented by the inner surface 76 of the rail 26 so that the rail may be snapped on or slidably engaged with the upper portion 74. As previously explained, it appears preferably to have three clip sections located along each of the four sides of a rectangularly shaped water bed frame. (A rail is secured to each of the three) A rail is secured to each of the three clip sections on a side and extends substantially along an entire side. As with the head portion 32 of the clip 20, the outer surface 78 of the rail may be beveled to allow the insertion of the fingers of an assembler, thereby flexing the holder away from the frame. Slight forward movements of the fingers achieve the tucking of the liner around the holder.

Returning once again to the FIG. 3 embodiment, it has been found suitable that the holder have a height of about three inches, that the leg portion be about $\frac{5}{8}$ inch in height, a sufficient distance to receive a screw or other fastener as shown in the FIG. 5 embodiment. The leg portion may also include a guide line 31 and prepunched holes to receive the fasteners. It is to be understood that smaller dimensions are more appropriate if the holder is used to mount ruffles or the like.

In order to provide the self-biasing or spring-like action of the holder, the holder is designed to have the head portion 32 offset by approximately $\frac{1}{8}$ inch. When the holder is unattached with nothing to bias the head portion it will be about $\frac{1}{8}$ inch to the left as shown in an exaggerated fashion in phantom lines in FIG. 3. However, when the leg portion is aligned vertically with the interior surfaces of the frame, the frame biases the head portion. Thus, when the holder is connected to the frame, the head portion will be forced back about $\frac{1}{8}$ inch. This places an overstress in the center portion of the clip which induces a biasing force in the clip against the interior surface 14. This biasing force will insure an adequate restraint on the liner once the liner is tucked into the space 38 and will also give the spring-back feature. Hence, once tucking is completed, the assembler need only remove his fingers and the holder will spring back against the liner.

Figure 4:
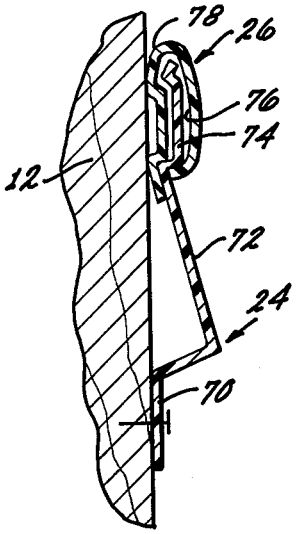
FIG. 4 is a diagrammatic elevational sectional view of another embodiment of the inventive liner holder taken along line 4—4 of FIG. 2*b*.

It is to be appreciated that the holder may be of metal as well as plastic; in the FIG. 2*b*, 4 embodiment the clip section may be a metal such as stainless or spring steel while the rail section may be plastic.

Referring again to FIGS. 2*a* and 2*b*, it can now be appreciated that should an assembler desire to retuck or make more taut the liner no difficulty would arise even if the water mattress is in place. Since the water is easily movable, the assembler can work on a small portion of the holder pulling it away from the frame without disturbing the remainder of the holder either on the same interior surface side or on any of the other interior surfaces of the frame. Of course once the assembler's fingers are removed, the self-biasing of the clip will cause the holder to move immediately into contact with the frame thereby holding the liner. In addition, the water mattress itself will resume its steady state condition in which it will also press outwardly against the interior surface of the frame adding an additional holding force to the liner as well as to bedding when the insert 60 is in place.

As mentioned in the first paragraph of the description various modifications are contemplated. For example, the holder may be formed in the shape of a bow (not shown) extending the vertical height of the frame or it may be shorter and extend downward from the top of the interior surface 14. The holder may also be bowed and have a laterally extending arm from the mid portion of its concave side to the frame to insure retention of the bowed shaped even under the influences of the force created by the water mattress. Or alternatively, the holder can be generally straight and be positioned upright against the interior surface 14 of the frame or generally straight while having an arm extending between the upper portion of the holder and the frame for locating the upper portion of the holder away from the frame whereby the holder is obliquely disposed relative to the interior surface 14. In all of these variations, the holder may be inexpensively formed of an extruded synthetic resin or even of different types of paper products.

Of course it is understood that a portion of the interior surface of 14 may be recessed to accommodate or receive a holder so that a flush appearance of the liner may be achieved. This will improve the aesthetic appearance of the bed and prevent accidental contact with the top of the liner.

In operation, the holder just described provides for a quick and easy assembly of a water bed. Initially the frame is put together. The next step is to secure the holder to the frame (the manner of attachment depending upon the leg portion design used). For example, nailing or stapling the clip as shown in FIG. 5 will take only a few moments; the extruded liner restrainer may be precut to the size of the frame and supplied by the frame manufacturer to the consumer. Next the liner is set within the frame and simply "tucked" around the holder until the liner is sufficiently taut. Tucking is achieved very easily by pulling back the resilient holder and rolling the liner with the fingertips into the space behind the center portion. The water mattress may then be positioned and filled with water. The final step is placing the bedding on top of the water mattress. If the embodiment shown in FIG. 3 is used, there will be no need to fasten the holder because the bedding insert 60 is inserted flush against the leg portion 34 to hold the holder in place.

It can now be understood that the holder may be used with any design or shape of frame, is inexpensive and simply constructed but yet highly reliable. Furthermore, the holder does not interfere with the aesthetic appearance of the frame or of the bedding as it is completely hidden when in use.

Referring now to FIG. 9, there is illustrated another modification of the holder 20 illustrated in FIG. 3. As with the holder 20, the holder 80, FIG. 9 includes a base portion 82, an integral head portion 84 and an integral leg portion 86. In addition, there is an arm portion 88 integral with the other three portions and located between the base portion and the leg portion. As with the FIG. 3 embodiment the FIG. 9 embodiment is biased so that the head portion 84 bears against a surface 90 so as to restrain any object which is placed between the surface 90 and the head portion 84.

From a functional standpoint the FIG. 9 embodiment has the advantage of being easily opened so that the object pressed between the head portion 84 and the surface 90 can be quickly and readily inserted or removed. This release is accomplished by applying a force upon the arm portion 88 to cause a pivoting action about the bend 92 whereby the base portion 82 and the head portion 84 are moved away from the surface 90. This force on the arm 88 is represented by the arrow 94. Other than the arm portion 88, the structure of the holder 80 is like that shown in FIG. 3 and functions in the same manner. In addition, the leg portion may be altered for example to any one of the variations shown in FIGS. 5–8. Furthermore, it should be noted that the FIG. 9 configuration, like the earlier configurations, can be made by extruding so as to maintain the low cost advantage mentioned herein above.

Referring now to FIG. 10, there is illustrated a bed headboard-canopy 100 comprising a top 102, a headboard 104, side curtains 106 and a valance 108. Attached to the top 102 but hidden from direct view and therefore illustrated in dotted line are a side holder 110 and a front holder 112, each of the holders having the same configuration as shown in FIG. 9. As can be appreciated, the side curtain 106 is mounted to the side holder 110 while the valance 108 is mounted to the front holder 112.

A major advantage of the holders can now be appreciated when it is realized that once the holder is fastened to the canopy curtains, valances, ruffles or the like may be very easily installed simply by placing the upper edge of the hanging element (i.e., the curtain, valance, ruffle or the like) over the head portion while allowing the remainder of the hanging element to come over and cover the holder so that from an aesthetic standpoint, the holder is invisible. It can now be appreciated that insertion and removable of a valance for example is substantially easier and can be more quickly accomplished than is presently the case with the standard curtain rods and brackets. In addition, there is no longer a need to hem a curtain or a valance so as to accommodate a curtain rod. This not only saves time during the manufacture of the item but also material, since such a hem always means a substantial overlap of material. If desired, a small hem may be used to form an increased dimension and thereby an interference lock. The hemmed portion will reside in the storage space and be unable to pass between the head portion and the surface until the head portion is purposely moved.

Four holders may also be mounted about a window. If the intersecting ends of the holders are mitered the holders form a complete periphery about the window. Thus a window cover may be secured to form a total block to outside light.

To emphasize the expanded breadth for the holder described herein, reference is now made to FIG. 11 which illustrates a clip board 114 to which is fastened a holder 116. It is noted from the drawing that the holder has been turned upside down when compared to the holder illustrated in FIG. 9. Nevertheless, it can be appreciated that the holder can function as the clip portion of the existing clip board. For example, the clip board 114 forms the surface upon which the head portion 118 of the holder bears. The leg portion 120 of the holder 116 is fastened to the clip board in any convenient manner such as by standard fasteners or if the board 114 and the holder 116 are made of plastic, then attachment may be caused by the application of heat. Operationally, the holder 116 is manipulated by the application of force on the arm portion 122 which pivots the head portion 118 to allow the insertion and removal of paper.

Another "clip board" variation is illustrated in FIG. 11a where a board 115 receives a holder 117 in a press-fitted arrangement. The holder 117 includes a head portion 119 and a leg portion 121. The leg portion is generally U-shaped and is pressed into the end of the board 115. If desired a projection 123 may be added to the leg portion; this is provided to engage a groove 125 in the board and thus aid in retaining the holder in position. Also, with the use of a projection the holder may be engaged with the board by merely laterally sliding the holder relative to the board.

Referring now to FIG. 12, another variation of the invention is illustrated, again exemplifying the wide variation of use to which the invention can be put. Illustrated is a holder 130 having an identical cross-sectional shape as the FIG. 9 embodiment except for the addition of parallel slits 132, 134, 136 and 138 which extend from the head portion such as head portion 140 to the leg portion 142. In effect, this forms five independently movable holder sections 144, 146, 148, 150 and 152. Each of these holders functions in an identical fashion to the holder 116 of FIG. 11, for example, the holder 146 is shown holding a piece of paper 154 as is the holder 152 wherein a piece of paper 156 is held. Such a system may, for example, be used in the kitchen of restaurants for holding order forms. Again, it is appreciated that the holder 130 may be very inexpensively formed from a single extruded element merely by cutting the extrusions at predetermined spaced intervals. The slits may also be leveled so that the holder 130 may be curved or bent into a circular configuration if desired.

Referring now to FIG. 13, there is illustrated still another variation of a holder 160 which is divided into two holder sections 162 and 164 by a slit 166. The holder section 164 has a circular opening 168 in the base portion 170. Such an opening allows a user to place his finger into the storage space located behind the base portion to pivot the head portion 172 away from the surface upon which it bears.

Another variation is the slot 174 formed in the holder section 162. Theslot like the hole allows a user to insert his finger in order to pivot the head portion 176 away from the mating surface. It is to be understood that the slotted opening 174 or the hole 168 may also be formed in a holder configuration such as that shown in FIG. 3. In addition, the FIG. 3 holder embodiment may be cut at predetermined spaced intervals to form holder sections.

FIG. 13 also illustrates a modification of the manner in which the holder is mounted or connected to a cooperating surface. As shown in FIGS. 5 and 9, fastening devices such as tacks or nails may be used to fix the leg portion to the surface. In FIG. 13 however, a mounting bar 178 is first fastened to the surface in any convenient manner such as by tacks or by adhesive. The bar has a recessed portion 180 for receiving the leg portion 182 of the holder. This allows for the easy removal and insertion of the holder itself.

The present invention may also be configured similar to a clothespin. Referring now to FIG. 14, there is illustrated two holders 190 and 192 which are placed in a mirrored relationship with the leg portions 194 and 196 being fastened in any suitable fashion such as with fasteners or by the use of heat. In operation, the holders 190 and 192 function identically to the holder 82 of FIG. 9 since each of the holders in effect forms a surface for the other holder. Thus, the head portions 198 and 200 will each be biased toward one another just as the head portion 84, FIG. 9 was based against the surface 90. Operation of the clothespin type holder is accomplished by applying forces to the arms 202, 204 which causes the head portions 198 and 200 to pivot away from each other, again in the same manner as the head portion pivoting away from the surface 90 when a force is applied to the arm 88 in the FIG. 9 embodiment.

Of course it is realized that many variations of a holder can be constructed which fall within the scope of the present invention. For example, additional configurations are shown in FIGS. 15 and 16. In FIG. 15, a holder 210 is shown which is constructed similarly to the holder in FIG. 9. Holder 210 includes an L-shaped leg 212 which is integrally formed with the base 214 and arm 216. In FIG. 16, the leg 218 of the holder 220 has the shape of an upside down "*h*". Again, each of the configurations FIGS. 15 and 16 may be extruded so as to minimize cost.

What is claimed is:

1. A holder for constraining movement of a sheet of material between itself and another surface to which the holder is attached, said holder comprising a single piece of resilient material having a leg portion for bearing against said other surface and for positioning and securing said holder, said leg portion being positioned to induce a stress in said holder wherein a spring-like quality is achieved;

a central portion having an end integral with said leg portion and being bowed outwardly from said other surface when said leg portion is positioned to bear against said other surface, said central portion being stressed by the position of said leg portion when bearing against said other surface to cause a biasing force in a direction toward said other surface, said central portion defining with said other surface a space for storage of peripheral sections of said sheet of material;

a head portion integral with an opposite end of said central portion biased toward said other surface when said leg portion is bearing against said other surface, said head portion being pivotal away from said other surface upon insertion of an operator's fingertips between said other surface and said head portion and operative to squeeze said sheet of material between it and said other surface and to obstruct removal of said sheet of material, said head portion for receiving said sheet of material in a circumscribed manner;

an inner surface extending in common between said leg portion and said central portion positioned to contact said other surface at said leg portion; and a smooth outer surface extending in common between said leg portion and said central portion for supporting said sheet of material and for being hidden thereby, said outer surface being located so as to remain in a non-contacting position relative to said other surface.

2. A holder is claimed in claim 1 wherein said head portion has a beveled, curvilinear shape for receiving the fingertips of an operator.

3. A holder as claimed in claim 1 including a rail engageable by said head portion and pressed by said head portion against said other surface.

* * * * *